US008077893B2

(12) United States Patent
Roy et al.

(10) Patent No.: US 8,077,893 B2
(45) Date of Patent: Dec. 13, 2011

(54) DISTRIBUTED AUDIO CODING FOR WIRELESS HEARING AIDS

(75) Inventors: Olivier Roy, Lausanne (CH); Martin Vetterli, Grandvaux (CH)

(73) Assignee: Ecole Polytechnique Federale de Lausanne, Lausanne (CH)

( * ) Notice: Subject to any disclaimer, the term of this patent is extended or adjusted under 35 U.S.C. 154(b) by 859 days.

(21) Appl. No.: 12/155,183

(22) Filed: May 30, 2008

(65) Prior Publication Data

US 2008/0306745 A1 Dec. 11, 2008

Related U.S. Application Data

(60) Provisional application No. 60/924,768, filed on May 31, 2007.

(51) Int. Cl.
*H04R 25/00* (2006.01)

(52) U.S. Cl. ..... 381/317; 381/312; 381/92; 381/318; 381/324; 381/314; 704/205; 704/209; 379/52

(58) Field of Classification Search ..... 381/317, 381/312, 313, 92, 318, 314, 309, 324, 71.11; 704/209, 500–504, 230, 233, 205, 215; 600/559; 379/52

See application file for complete search history.

(56) References Cited

U.S. PATENT DOCUMENTS 5,479,560 A * 12/1995 Mekata ..... 704/209
5,524,056 A * 6/1996 Killion et al. ..... 381/314
5,524,150 A * 6/1996 Sauer ..... 381/309
5,611,018 A * 3/1997 Tanaka et al. ..... 704/215
5,636,285 A * 6/1997 Sauer ..... 381/314
5,757,933 A * 5/1998 Preves et al. ..... 381/313
5,859,916 A * 1/1999 Ball et al. ..... 381/326
5,918,203 A * 6/1999 Herre et al. ..... 704/205
6,101,258 A * 8/2000 Killion et al. ..... 381/321

(Continued)

OTHER PUBLICATIONS

Frank Baumgarte et al., "Binaural Cue Coding Part I: Psychoacoustic Fundamentals and Design Principles" IEEE Transactions on Speech and Audio Processing, vol., 11 No. 6, Nov. (2003) pp. 509-519.

(Continued)

*Primary Examiner* — Vijay Chawan
(74) *Attorney, Agent, or Firm* — Harness, Dickey & Pierce, P.L.C.

(57) ABSTRACT

The aim of the invention is to provide inter-channel level differences ICLD related to audio signals for hearing aids. This aim is achieved by a method for computing ICLD from a first and second audio source signals, the first source signal being wired with a first processing module and the second source signal being wired with a second processing module, the second processing module receiving wirelessly information from the first processing module, this method comprising the steps of: acquiring first samples of the first sound signal by the first processing module, defining a first time frame, converting the first time frame into first frequency bands and grouping them into two first frequency sub-bands, calculating a first power estimate of each first frequency sub-bands, encoding and transmitting same to the second processing module, acquiring second samples of the second sound signal by the second processing module, defining a second time frame comprising acquired samples, converting same into second frequency bands, grouping them into two second frequency sub-bands, calculating a second power estimate of each second frequency sub-bands, receiving and decoding the encoded first power estimates, computing for each frequency sub-band, an ICLD by subtracting the first decoded power estimates and the second power estimates.

5 Claims, 2 Drawing Sheets
(1 of 2 Drawing Sheet(s) Filed in Color)

U.S. PATENT DOCUMENTS

| | | | | |
|---|---|---|---|---|
| 6,154,552 | A * | 11/2000 | Koroljow et al. | 381/313 |
| 6,219,427 | B1 * | 4/2001 | Kates et al. | 381/318 |
| 7,206,423 | B1 * | 4/2007 | Feng et al. | 381/312 |
| 7,415,120 | B1 * | 8/2008 | Vaudrey et al. | 381/109 |
| 7,756,281 | B2 * | 7/2010 | Goldstein et al. | 381/309 |
| 7,760,898 | B2 * | 7/2010 | Howell et al. | 381/327 |
| 7,890,323 | B2 * | 2/2011 | Akamatsu | 704/230 |
| 7,933,226 | B2 * | 4/2011 | Woodruff et al. | 370/260 |
| 2005/0248717 | A1 * | 11/2005 | Howell et al. | 351/41 |
| 2006/0274747 | A1 * | 12/2006 | Duchscher et al. | 370/389 |
| 2007/0270988 | A1 * | 11/2007 | Goldstein et al. | 700/94 |
| 2009/0003629 | A1 * | 1/2009 | Shajaan et al. | 381/113 |
| 2009/0299739 | A1 * | 12/2009 | Chan et al. | 704/225 |

OTHER PUBLICATIONS

Christof Faller et al., "Binaural Cue Coding Part II: Schemes and Applications" IEEE Transactions on Speech and Audio Processing, vol. 11 No. 6, Nov. (2003) pp. 520-531.

* cited by examiner (a)

(b)

DISTRIBUTED AUDIO CODING FOR WIRELESS HEARING AIDS

PRIORITY STATEMENT

The present application hereby claims priority under 35 U.S.C. §119(e) on U.S. provisional patent application No. 60/924,768 filed May 31, 2007, the entire contents of which is hereby incorporated herein by reference.

INTRODUCTION

The present application concerns the field of hearing aids, in particular the processing of multi-sources signals.

BACKGROUND

The problem of interest is related to the multi-channel audio coding method described in [1,2]. In a nutshell, the idea is to describe multi-channel audio content as a down-mixed (mono) channel along with a set of cues referred to as "inter-channel level difference" (ICLD) and "inter-channel time difference" (ICTD). These cues have been shown to well capture the spatial correlation between the microphone signals [1]. The mono signal and the cues are transmitted by an encoder to a decoder. This latter retrieves the original multi-channel audio signals by applying these cues on the received mono signal.

The direct use of this method for our application is however not possible since the signals of interest (left and right hearing aids) are not available centrally. The cues must thus be computed in a "distributed" fashion. This involves the use of a rate-constrained wireless communication link which entails coding methods, such as the one presented here, that target low communication bit-rates and low delays. Moreover, the goal of the proposed scheme is not to retrieve a multi-channel audio input from a down-mixed signal, as it is the case in [1,2], but the left (resp. right) audio channel using the right (resp. left) audio input. This requires the development of novel reconstruction methods specifically tailored for this purpose.

SUMMARY

The aim of at least one embodiment of the invention is to provide inter-channel level differences related to audio signals for hearing aids.

This aim is achieved by a method for computing inter-channel level differences from a first audio source signal $x_1$ and a second source signal $x_2$, the first source signal $x_1$ being wired with a first processing module PM1 and the second source signal $x_2$ being wired with a second processing module PM2, the second processing module PM2 receiving wirelessly information from the first processing module PM1, this method comprising the steps of:

(a) acquiring first samples of the first sound signal $x_1$ by the first processing module PM1, (b) defining a first time frame comprising several acquired samples of the first source signal, (c) converting the first time frame into first frequency bands, (d) grouping the first frequency bands into at least two first frequency sub-bands, (e) calculating a first power estimate of each first frequency sub-bands, (f) encoding the first power estimates and transmitting the encoded first power estimates to the second processing module PM2, (g) acquiring second samples of the second sound signal $x_2$ by the second processing module PM2, (h) defining a second time frame comprising several acquired samples of the second source signal, (i) converting the second time frame into second frequency bands, (j) grouping the second frequency bands into at least two second frequency sub-bands, (k) calculating a second power estimate of each second frequency sub-bands, (l) receiving and decoding the encoded first power estimates, (m) computing for each frequency sub-band, an inter-channel level difference by subtracting the first decoded power estimates and the second power estimates.

The general setup of interest is illustrated in FIG. 1(*a*). A user is equipped with a binaural hearing aid system, that is, a left and a right hearing aid here-after referred to as hearing aid 1 and 2, respectively. They each comprise at least one microphone, a loudspeaker, a processing module (PM) and wireless communication capabilities. We denote by $x_1$ and $x_2$ the signal recorded at hearing aid 1 and 2, respectively. The two devices wish to exchange data over a wireless link in order to compute binaural cues that may be subsequently used to provide an estimate of the signal available at the contralateral device. The bidirectional communication setup is depicted in FIG. 1(*b*). Owing to the inherent symmetry of the problem, the rest of the discussion will adopt the perspective of one hearing device (say hearing aid 1). In this case, the communication setup reduces to that shown in FIG. 1(*c*). The signal $x_1$ is recorded and then converted by the PM of hearing aid 1 (PM1) into a bit stream that is wirelessly transmitted to the PM of hearing aid 2 (PM2). Based on the received data and its own signal $x_2$, this latter computes binaural cues and a reconstruction $\hat{x}_1$ of the signal available at the contralateral device.

BRIEF DESCRIPTION OF THE FIGURES

The patent or application ffie contains at least one drawing executed in color. Copies of this patent or patent application publication with color drawing(s) will be provided by the Office upon request and payment of the necessary fee.

The invention will be better understood thanks to the following detailed description of example embodiments and with reference to the attached drawings which are given as a non-limiting example, namely.

DETAILED DESCRIPTION OF THE EMBODIMENTS OF THE INVENTION

Figure 1:
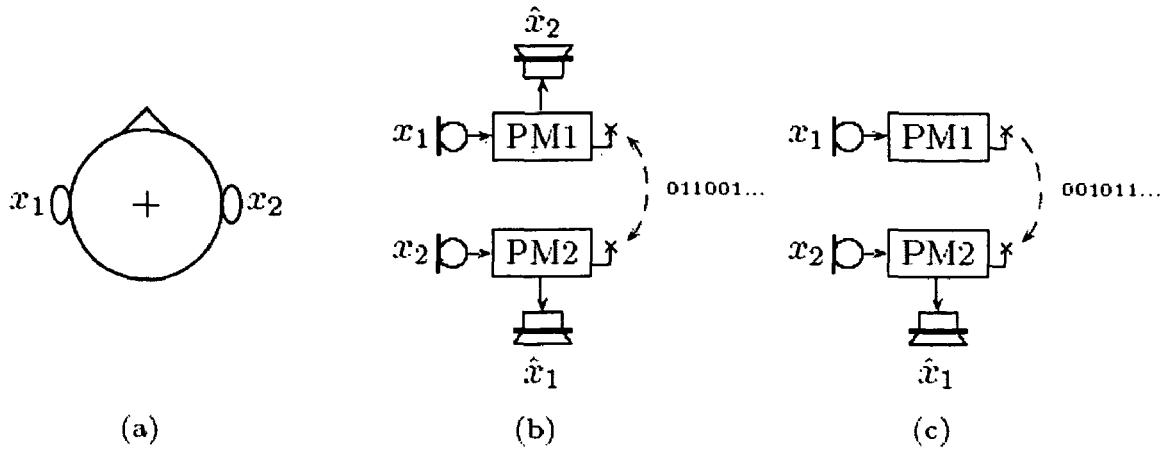
FIG. 1 illustrates binaural hearing aids. (a) Typical recording setup. (b) Bidirectional communication setup. (c) Communication setup from the perspective of hearing aid.

It has been shown in [1] that the perceptual spatial correlation between $x_1$ and $x_2$ can be well captured by binaural cues referred to as inter-channel level difference (ICLD) and inter-channel time difference (ICTD). If a PM has access to both $x_1$ and $x_2$, those cues can be easily computed and then subsequently used to modify the input signals. Moreover, if these cues need to be transmitted, a significant bitrate saving can be achieved by realizing that ICLDs and ICTDs vary slowly across time and frequency and thus only need to be estimated on a time-frequency atom basis. The setup considered in this work is different in the sense that $x_1$ and $x_2$ are not available centrally. The cues must hence be estimated and coded in a distributed fashion. The details of the proposed method are now given.

All the processing in the proposed algorithm is performed using a time-frequency representation. In its most general form, the transformation is achieved by means of a filter bank that maps the discrete-time input signal $x_1$ [n] into a time-frequency representation $X_i[m, k]$ (i=1, 2). The index m denotes the frame number and k the frequency component. A particular case is a discrete Fourier transform (DFT) filter bank where the freedom in the design reduces to the choice of an analysis filter g[n], a synthesis filter h[n], the interpolation/decimation factor M and the number of frequency channels K. We denote the length of the analysis and synthesis filters by $N_g$ and $N_{hl}$, respectively. These parameters should be carefully chosen in order to allow for perfect reconstruction.

The DFT filter bank can be efficiently implemented using a weighted overlap-add (WOLA) structure, where the filter h[n] and g[n] act as analysis and synthesis windows. This structure is computationally efficient and is therefore a preferred choice for the proposed method. The WOLA structure can be further simplified by considering windows whose length are smaller that the number of frequency channels K ($N_g$, $N_h \leqq K$). In this case, the signal $x_1$ [n] is segmented into frames of size K. Each frame is then multiplied by the analysis window g[n]. Note that g[n] is zero-padded at the borders if $N_g<K$. A K-point DFT is then applied. After one frame has been computed, the next frame is obtained by shifting the input signal by M samples. This process results in the time-frequency representation $X_i[m, k]$ where $m \in Z$ and k=0, 1, . . . , K−1.

Note that the input signal is real-valued such that the spectrum is conjugate symmetric. Only the first K/2+1 frequency coefficients of each frame need to be considered.

If a discrete-time signal $\hat{x}_i[n]$ needs to be reconstructed from the time-frequency representation $\hat{X}_i[m, k]$, the above operations are performed in reverse order. More precisely, a K-point inverse DFT is applied on each frame. Each frame is then multiplied by the (possibly zero-padded) synthesis window h[n]. The output frames are then overlapped with a relative shift of M samples and added to produce the output sequence $\hat{x}_i[n]$.

Analysis

The multi-channel audio coding scheme presented in [2] demonstrates that estimating a single spatial cue for a group of adjacent frequencies is sufficient to describe the spatial correlation between $x_1$ and $x_2$. For each frame m, the K/2+1 frequency indexes are grouped in frequency sub-bands according to a partition $\beta_1$ (l=0, 1, . . . , L−1), i.e., such that $$\bigcup_{l=0}^{L-1} \beta_l = \{0, 1, \ldots, K/2\} \text{ and } L-1\beta_l \cap \beta_{l'} = \phi \text{ for all } l \neq l'.$$

Note that, in the sequel, frequency sub-bands are always indexed with l whereas frequencies are indexed with k. The above grouping corresponds to one step of grouping the first frequency bands into at least two first frequency sub-bands.

Figure 2:
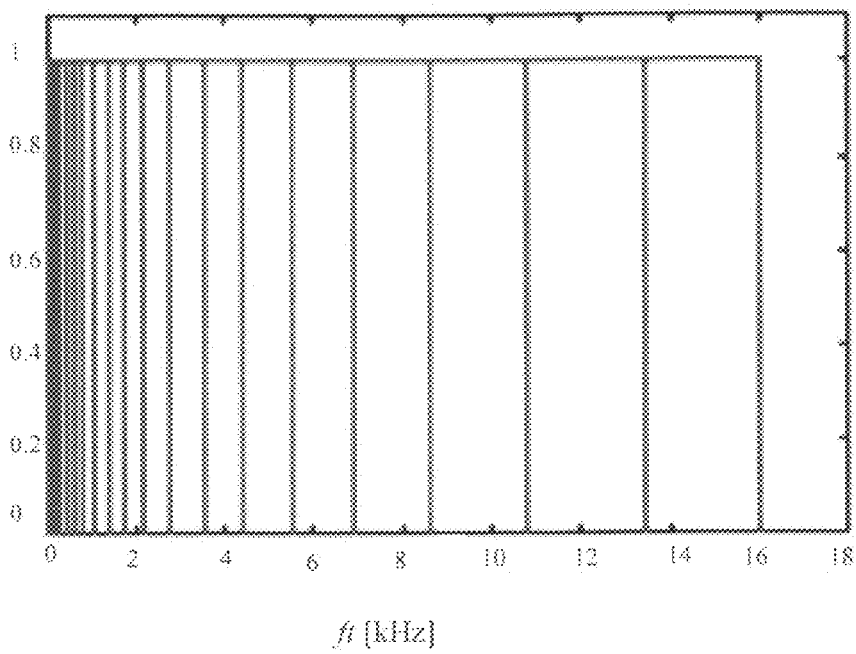
FIG. 2 illustrates time-frequency processing. (a) Partitioning of the frequency band in frequency sub-bands. (b) Power estimates as a function of time and frequency.
Figure 2:
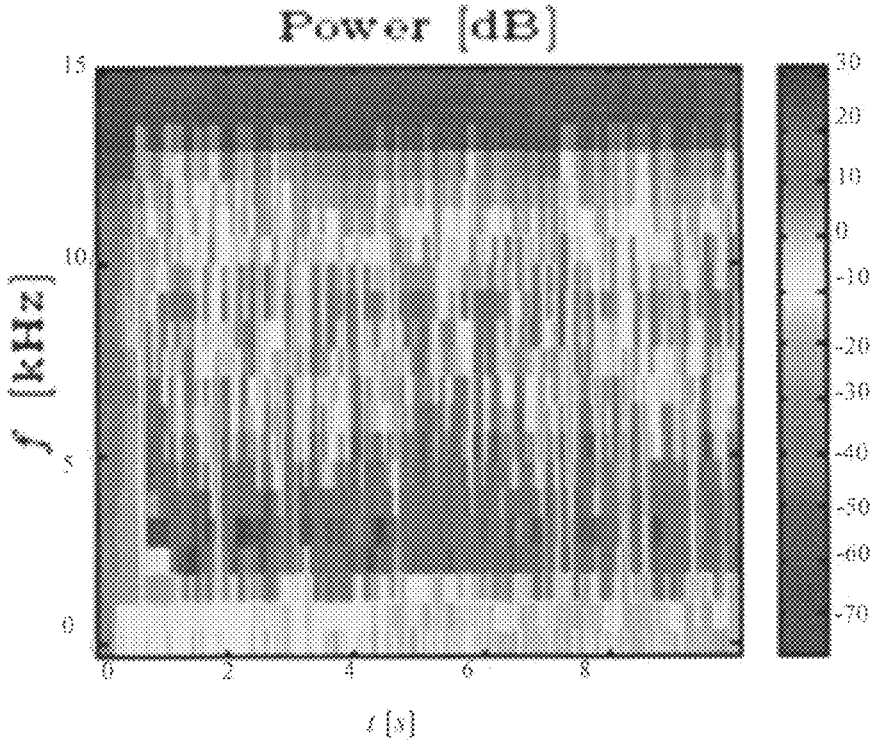

Psychoacoustic experiments suggests that spatial perception is most likely based on a frequency sub-band representation with bandwidths proportional to the critical bandwidth of the auditory system. A preferred grouping for the proposed method considers frequency sub-bands with a constant equivalent rectangular bandwidth (ERB) of size $N_b$. More precisely, we consider a non-uniform partitioning of the frequency band according to the relation $$N_b(f)=21.4 \log_{10}(6.00437f+1),$$

where f is the frequency measured in Hertz. This is shown in FIG. 2(*a*). The analysis part of the proposed algorithm at frame m simply consists in computing at both PMs an estimate of the signal power, in dB, for each frequency sub-band B1 as $$pi[m, l] = 10\log_{10}\left(\frac{1}{|\beta l|}\sum_{k \in \beta l} |X_i[m, k]|^2\right) \text{ for } i = 1, 2.$$

This is covered by the steps of: calculating a first power estimate of each first frequency sub-bands, and calculating a second power estimate of each second frequency sub-bands. A typical representation of such power estimates is depicted in FIG. 2(*b*). Note that $p_1$[m, l] and $p_2$[m, l] will allow to compute ICLDs for each frequency sub-band.

Encoding and Decoding

We now explain how PM1 can efficiently encode its power estimates for frame m taking into account the specificities of the hearing aid recording setup. These power estimates will be necessary for the computation of ICLDs at PM2. The decoding procedure at PM2 is also explained. This description corresponds to the step: encoding the first power estimates and transmitting the encoded first power estimates to the second processing module PM2, And: receiving and decoding the encoded first power estimates. The way it is encoded can be summarized as follows:

(a) quantizing the power estimate within a predefined range, (b) applying a modulo function on the quantized power estimate, the modulo value being specific for each frequency sub-band to produce an index, the range of said index being lower than the range of the quantized power estimate, (c) the index forming the encoded power estimate.

In the same manner the way to decode the encoded power estimate can be summarized as follows:

(a) quantizing the second power estimate within the predefined range, (b) defining a sub-range of modulo in which the quantized second power estimate is located within the predefined range, (c) using the defined sub-range and the encoded first power estimate to calculate the decoded first power estimate.

Note that the encoding and decoding procedures for PM2 simply amounts to exchange the role of the two PMs. The key is to observe that, while $p_1$[m, l] and $p_2$[m, l] may vary significantly as a function of the frequency sub-band index l, the ICLDs, defined as $$\Delta p[m,l]=p_1[m,l]-p_2[m,l],$$

are bounded above (resp. below) by the level difference caused by the head when a source is on the far left (resp. the far right) of the user. Let us denote by h1,'[n] and h2,'[n] the left and right head-related impulse responses (HRIR) at elevation zero and azimuth', and by $H_1$, $\phi[k]$ $H_2$, $\phi[k]^2$ the corresponding HRTFs. The ICLD in frequency sub-band l can be computed as a function of $\phi$ as[1]

$$\Delta p_\varphi[l] = 10\log_{10}\frac{\frac{1}{|\beta_l|}\sum k \in \beta_l |H_{1,\varphi}[k]|^2}{\frac{1}{|\beta_l|}\sum k \in \beta_l |H_{2,\varphi}[k]|^2} \quad (1)$$

and is thus contained in the interval given by $$[\Delta p_{min}[l], \Delta p_{max}[l]] = \left[\Delta p_{\frac{\pi}{2}}[l], \Delta p_{-\frac{\pi}{2}}[l]\right] \quad (2)$$

In the centralized scenario, ICLDs can hence be quantized by a uniform scalar quantizer with range (2).

Figure 3:
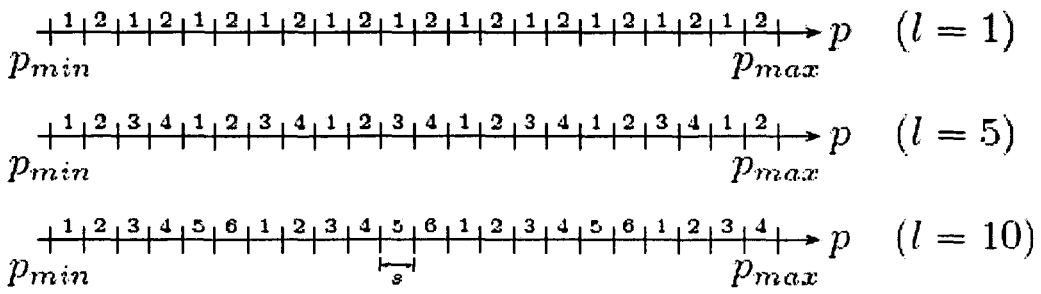
FIG. 3 illustrates the proposed modulo coding approach.

In our case, an equivalent bitrate saving can be achieved using a modulo approach. The power p is always quantized using a scalar quantizer with range $\lfloor p_{min}, p_{max}\rfloor$ and stepsize s. Indexes, however, are assigned modulo the ICLD range $\overline{\Delta}i[l]$ specific to each frequency sub-band. In the example of FIG. 3, the index reuse for l=1 (low frequencies) is more frequent than at l=10 (high frequencies).

The powers $p_1[m,l]$ and $p_2[m,l]$ are quantized using a uniform scalar quantizer with range [p min, p max] and stepsize s. The range can be chosen arbitrarily but must be large enough to accommodate all relevant powers. The resulting quantization indexes $i_1[m,l]-i_2[m,l]$ satisfy $$i_1[m, l] - i_2[m, l] \in \{\Delta i_{min}[l], \Delta i_{max}[l]\} = \left\{\left\lfloor\frac{\Delta p_{min}[l]}{s}\right\rfloor, \left\lceil\frac{\Delta p_{max}[l]}{s}\right\rceil\right\} \quad (3)$$

where $\lfloor\bullet\rfloor$ and $\lceil\bullet\rceil$ denote the floor and ceil operation, respectively. We equally refer to these quantization indexes as the encoded power estimates. Since $i_2[m,l]$ is available at PM2, PM1 only needs to transmit a number of bits that allow PM2 to choose the correct index among the set of candidates whose cardinality is given by $$\overline{\Delta}i[l]=\Delta i_{max}[l]-\Delta i_{min}[l]+1$$

This can be achieved by sending the value of the indexes $i_1[m,l]$ modulo $\overline{\Delta}i[l]$, i.e., using only log 2 $\overline{\Delta}i[l]$ bits. This strategy thus permits a bitrate saving equal to that of the centralized scenario. The decoded value is referred to as the decoded power estimate. Moreover, at low frequencies, the shadowing effect of he head is less important than at high frequencies. The corresponding $\overline{\Delta}i[l]$ can thus be chosen smaller and the number of required bits can be reduced. Therefore, the proposed scheme takes full benefit of the characteristics of the binaural recording setup. The modulo values $\overline{\Delta}i[l]$ may also be adapted over time by exploiting the interactive nature of the communication link between the two PMs. From an implementation point-of-view, a single scalar quantizer with stepsize s is used for all frequency sub-bands. The modulo strategy thus simply corresponds to an index reuse as illustrated in FIG. 3. At PM2, the index $i_2[m,l]$ is first computed and among all possible indexes $i_2[m,l]$ satisfying equation (3), the one with the correct modulo is selected. The decoded power estimates are denoted $\hat{p}_1[m,l]$. This corresponds to the step of computing for each frequency sub-band, an inter-channel level difference by subtracting the first decoded power estimates and the second power estimates.

For each frequency sub-band, the ICLD at PM2 is computed as $$\Delta\hat{p}[m,l]=\hat{p}_1[m,l]-p_2[m,l] \text{ for } l=0,1,\ldots,L-1 \quad (4)$$

In order to reconstruct the signal $x_1$ at PM2, suitable interpolation is then applied to obtain the ICLDs $\Delta\hat{p}[m, k]$ over the entire frequency band, i.e., for k=0, 1, . . . , K/2. Moreover, to provide an accurate spatial rendering of the acoustic scene in real scenarios, ICLDs are not sufficient. Phase differences between the two signals must also be computed. These ICTDs will be inferred from ICLDs. This strategy requires no additional information to be sent, keeping the communication bitrate to a bare minimum. In a preferred scenario, we resort to an HRTF lookup table that allows to map the computed ICLDs to ICTDs. This is achieved as follows. For each frequency sub-band 1, we first compute the ICLDs given by equation (1) for a set of azimuths $\phi \in \lambda$ and select the ICLD closest to that obtained in the prior art. The chosen azimuthal angle, denoted $\hat{\phi}_1$, hence follows as $$\hat{\varphi}_l = \underset{\varphi\in A}{\operatorname{argmin}}|\Delta\hat{p}[m, l] - \Delta p_\varphi[l]|.$$

The corresponding ICTD, denoted $\Delta\hat{\tau}_a[m,l]$, and expressed in samples, is then computed as the difference between the positions of the maxima in the corresponding HRIRs, namely $$\Delta\hat{T}_a[m, l] = \underset{n}{\operatorname{argmax}}|h_{1,\hat{\varphi}l}[n]| - \underset{n}{\operatorname{argmax}}|h_{2,\hat{\varphi}l}[n]|.$$

Note that the above operations can be implemented by means of a simple lookup table where the relevant ICLD-ICTD pairs are pre-computed for the set of azimuths λ. Similarly to the ICLDs, ICTDs $\Delta\hat{\tau}_a[m, k]$ are obtained for all frequencies by interpolation.

To reconstruct the signal $x_1$ from the signal $x_2$ available at PM2, the computed ICLDs are applied on the time-frequency representation of $X_2[m, k]$ as $$\hat{X}_{1a}[m, k] = X_2[m, k]10^{\frac{\Delta\hat{p}[m,k]}{20}}$$

The computed ICTDs are then imposed on the time-frequency representation obtained in (5) as follows $$\hat{X}_{1b}[m, k] = \hat{X}_{1a}[m, k]e^{-j\frac{2\pi}{K}k\Delta\hat{\tau}_a[m,k]}$$

In order to have smoother variations over time and to take into account the power of the signals for time-delay synthesis, we recompute the ICTDs based on the time-frequency representation $\hat{X}_{1b}$ as if it were the true spectrum $X_1$. More precisely, we compute a smoothed estimate of the cross power spectral density S12 between $x_1$ and $x_2$ as $$S_{12}[m,k]=\alpha\hat{X}_{1b}[m,k]X^*_2[m,k]+(1-\alpha)S_{12}[m-1,k],$$

where the superscript * denotes the complex conjugate and α the smoothing factor. At initialization, $S_{12}[0, k]$ is set to zero for all k. Let us denote by $\angle S_{12}[m,k]$ the phases of $S_{12}$. The final ICTDs $\Delta\hat{\tau}_a[m,k]$ are obtained by grouping the phases in frequency sub-bands and perform a least mean-squared fitting through zero for each band. The slopes of the fitted lines correspond to the ICTDs. We obtain $$\Delta\hat{\tau}[m, l] = \frac{K}{2\pi} \frac{\sum_{k \in \beta_l} k \angle S_{12}[m, k]}{\sum_{k \in \beta_l} k^2}.$$

Since ICTDs are most important at low frequencies, we only synthesize them up to a maximum frequency $f_m$. For sufficiently small $f_m$, the phase ambiguity problem can thus be neglected. Finally, the interpolated values $\Delta\hat{\tau}[m,k]$ allow to reconstruct the spectrum from equation (5) as $$\hat{X}_{1b}[m, k] = \hat{X}_{1a}[m, k] e^{-j\frac{2\pi}{K} k \Delta\hat{\tau}[m,k]}$$

REFERENCES

[1] F. Baumgarte and C. Faller, "*Binaural cue coding—Part I: Psychoacoustic fundamentals and design principles,*" *IEEE Trans. Speech Audio Processing,* vol. 11, no. 6, pp. 509-519, November 2003.

[2] F Baumgarte and C. Faller, "*Binaural cue coding—Part II: Schemes and applications,*" *IEEE Trans. Speech Audio Processing,* vol. 11, no. 6, pp. 520-531, November 2003.

The invention claimed:

1. Method for computing inter-channel level differences from a first audio source signal $x_1$ and a second source signal $x_2$, the first source signal $x_1$ being wired with a first processing module PM1 and the second source signal $x_2$ being wired with a second processing module PM2, the second processing module PM2 receiving wirelessly information from the first processing module PM1, this method comprising the steps of:

(a) acquiring first samples of the first sound signal $x_1$ by the first processing module PM1, (b) defining a first time frame comprising several acquired samples of the first source signal, (c) converting the first time frame into first frequency bands, (d) grouping the first frequency bands into at least two first frequency sub-bands, (e) calculating a first power estimate of each first frequency sub-bands, (f) encoding the first power estimates and transmitting the encoded first power estimates to the second processing module PM2, (g) acquiring second samples of the second sound signal $x_2$ by the second processing module PM2, (h) defining a second time frame comprising several acquired samples of the second source signal, (i) converting the second time frame into second frequency bands, (j) grouping the second frequency bands into at least two second frequency sub-bands, (k) calculating a second power estimate of each second frequency sub-bands, (l) receiving and decoding the encoded first power estimates, (m) computing for each frequency sub-band, an inter-channel level difference by subtracting the first decoded power estimates and the second power estimates.

2. Method of claim 1, further comprising the steps of:

(a) encoding the second power estimates and transmitting the encoded second power estimates to the first processing module PM1, (b) receiving and decoding the encoded second power estimates by the first processing module PM1, (c) calculating for each frequency sub-band, an inter-channel level difference by subtracting the first power estimates and the second decoded power estimates.

3. Method of claim 1, in which the step of encoding comprises the following steps, for each power estimate:

(a) quantizing the power estimate within a predefined range, (b) applying a modulo function on the quantized power estimate, the modulo value being specific for each frequency sub-band to produce an index, the range of said index being lower than the range of the quantized power estimate, (c) the index forming the encoded power estimate.

4. Method of claim 3, in which the step of decoding comprises the following steps, for each encoded first power estimate:

(a) quantizing the second power estimate within the predefined range, (b) defining a sub-range of modulo in which the quantized second power estimate is located within the predefined range, (c) using the defined sub-range and the encoded first power estimate to calculate the decoded first power estimate.

5. Method to produce a rebuild first input signal using inter-channel level differences as computed in claim 1, further comprising the steps of:

(a) producing output sound sub-bands based on the inter-channel level differences and the second frequency sub-bands (b) converting the output sound sub-bands into time domain to produce the rebuild first input signal output sound signal $\hat{x}_1$.

* * * * *